US005592767A

United States Patent [19]

Treske

[11] Patent Number: 5,592,767

[45] Date of Patent: Jan. 14, 1997

[54] HOLDER FOR IDENTIFICATION CARDS

[76] Inventor: Dieter Treske, 13700 Bellevue Dr., Minnetonka, Minn. 55345

[21] Appl. No.: 349,545

[22] Filed: Dec. 5, 1994

[51] Int. Cl.[6] ..... G09F 3/20

[52] U.S. Cl. ..... 40/649; 40/666; 40/1.6; 24/3.11; 24/3.12

[58] Field of Search ..... 40/1.5, 1.6, 537, 40/666, 642, 649, 667, 904, 765, 775; 206/39; 150/147; 24/3.11, 3.12

[56] References Cited

U.S. PATENT DOCUMENTS

| | | | |
|---|---|---|---|
| 1,652,842 | 12/1927 | Tanner | 40/649 |
| 2,725,913 | 12/1955 | Horwin | 150/39 |
| 4,000,570 | 1/1977 | Carmen | 40/1.5 |
| 4,141,400 | 2/1979 | Mangan | 150/39 |
| 4,259,797 | 4/1981 | Belser | 40/1.5 |
| 4,450,955 | 5/1984 | Featherston | 206/39.6 |
| 4,509,277 | 4/1985 | Bolton | 40/1.5 |
| 4,518,080 | 4/1985 | Ohlson | 206/39 |
| 4,616,435 | 10/1986 | Perfect | 40/642 X |
| 4,915,215 | 4/1990 | Brekke | 206/39 |
| 4,937,963 | 7/1990 | Barnes | 40/642 |
| 5,069,333 | 12/1991 | Chen | 150/147 X |
| 5,217,056 | 6/1993 | Ritter | 150/147 |
| 5,235,728 | 8/1993 | Nordberg | 24/3.11 |

FOREIGN PATENT DOCUMENTS

| | | | |
|---|---|---|---|
| 251900 | 1/1988 | European Pat. Off. | 150/147 |
| 4226341 | 2/1994 | Germany | 40/1.6 |
| 8910605 | 11/1989 | WIPO | 40/642 |

*Primary Examiner*—Brian K. Green
*Attorney, Agent, or Firm*—Anthony G. Eggink

[57] ABSTRACT

A durable holder for retaining and displaying cards is disclosed. When the holder is manufactured from opaque materials, an inserted card is readily displayed to viewers without requiring removal of the card. The holder includes a clip for securing the holder to an object quickly and efficiently. A second clip may be secured to the first clip thereby further allowing the holder to be alternately attached to other articles.

19 Claims, 5 Drawing Sheets

HOLDER FOR IDENTIFICATION CARDS

BACKGROUND OF THE INVENTION

I. FIELD OF THE INVENTION

The present invention relates generally to a holder for cards, and more particularly to an economic, durable holder for retaining and displaying an identification card. An opaque thermoplastic resin may be used to manufacture the holder without requiring the user to remove the card from the holder in order to view the card. A flexible clip is integral with the holder, allowing the user to fasten the holder to an object. The flexible clip reduces the amount of manual manipulation required to fasten the holder to an object.

II. DISCUSSION OF THE RELATED ART

A typical holder for holding cards consists of a transparent housing having a slot for sliding the card into the housing. For example, Mangan, U.S. Pat. No. 4,241,400, discloses a protective holder for magnetic cards. The holder consists of two plates that are held together thereby defining a pocket for inserting a card having a magnetic strip on one face. The holder is molded of substantially rigid nonmagnetic plastic material. When an opaque plastic material is used, the card must be removed from the holder in order to view the card inserted within the holder. Also, the holder does not have a means for securing the holder to other objects. Therefore, a need exists for a holder which retains a card and allows viewing of the card without removal therefrom. Also, a need exists for a holder which is easily fastened to an object.

Featherston, U.S. Pat. No. 4,450,955, discloses a holder having an open top and bottom, consisting of a panel having parallelly opposing folded over lips which form a pocket for receiving a card. A card is inserted through either the top opening or the bottom opening. Featherston does not teach or describe a means for fastening the holder to objects. Also, when displaying the inserted card, the card may have a tendency to gradually slide out of the holder through either the top or bottom opening. Therefore, a need exists for a holder that retains the card within the holder while displaying the inserted card. A further need exists for a holder that retains and displays an inserted card while being readily attachable to an object.

Bolton, U.S. Pat. No. 4,509,277, discloses a holder consisting of a first sheet which is heat sealed onto two transparent compartment and pocket forming sheets. When an opaque sheet material is used, the card must be removed from each pocket before the viewer may read the card. Therefore, there is a need for a holder which both retains and displays a card, when the holder is manufactured from an opaque material.

The present invention overcomes these disadvantages and meets the present needs by providing a holder that may be manufactured from opaque materials yet still retains and displays the card without requiring removal. The present holder also has a clip which allows the user to quickly secure the holder to an object while reducing the amount of manual manipulation required to fasten the holder to an object.

SUMMARY OF THE INVENTION

The purpose of the present invention is to provide a holder that displays and retains a card, wherein the holder is easily fastened or attached to an object. The holder has an open front to permit viewing of a card inserted within the holder. The holder has a first clip which is integral with the holder, which allows the holder to be securely attached to an object. The first clip has slots which allow a second clip to be attached to the holder. The second clip provides an alternative means for attaching the holder to an object. The preferred embodiment of the holder consists of a panel, a frame having three sides integral with the panel forming an open top, a card retaining slot, and a first flexible clip. Another preferred embodiment includes a crossbar partially forming a fourth side of the frame, which further frames the card when viewing.

Various types of cards may be retained in the holder. Without limitation, identification badges, credit cards, security access cards, corporate identification badges, and the like are retained within the holder. The holder is manufactured from a thermoplastic polymer. The open front of the holder allows viewing of the card face even when opaque thermoplastic polymers are utilized. Hence, when opaque thermoplastic polymers are used, the card may be viewed without removing the card from the holder. Further, when a bar code is applied to the front face of the card, a bar code reader may read the bar code through the open front without requiring the removal of the card from the holder. Also, the first flexible clip of the holder is easily attached to, for example, a shirt pocket without requiring manual manipulation of the clip. A second clip and strap may be attached to the first clip which allows the user to fasten the holder to objects which cannot be efficiently fastened using the first clip. The ability to easily attach a second clip to the first clip provides additional means for attaching the holder which otherwise would not be available.

In alternate preferred embodiments of the present invention, the card may be securely retained within the holder in either a vertical or horizontal alignment with a viewer. Further, the first clip is integrally formed with the holder such that the holder may be clipped to an object, thereby presenting the card in either a vertical or horizontal fashion. The user may clip the holder to an object such that the open top is facing upwards.

It is accordingly a principal object of the present invention to provide a holder for retaining and displaying a card, optionally manufactured from opaque thermoplastic polymers, whereby the user may view an inserted card without removing the card from the holder.

Another object of the present invention is to provide a holder for retaining and displaying cards which is easily secured to an object.

Still a further object of the present invention is to provide a holder for retaining and displaying a card which allows the card's length axis to be displayed horizontally to a viewer.

Yet another object of the present invention is to provide a holder for retaining and displaying a card, wherein the card's length axis may be displayed vertically to the viewer.

These and other objects of the present invention will be readily apparent to those skilled in the art from a review of the following detailed description of the preferred embodiment in conjunction with the accompanying drawings and claims.

DETAILED DESCRIPTION OF THE PREFERRED EMBODIMENT

Figure 1:
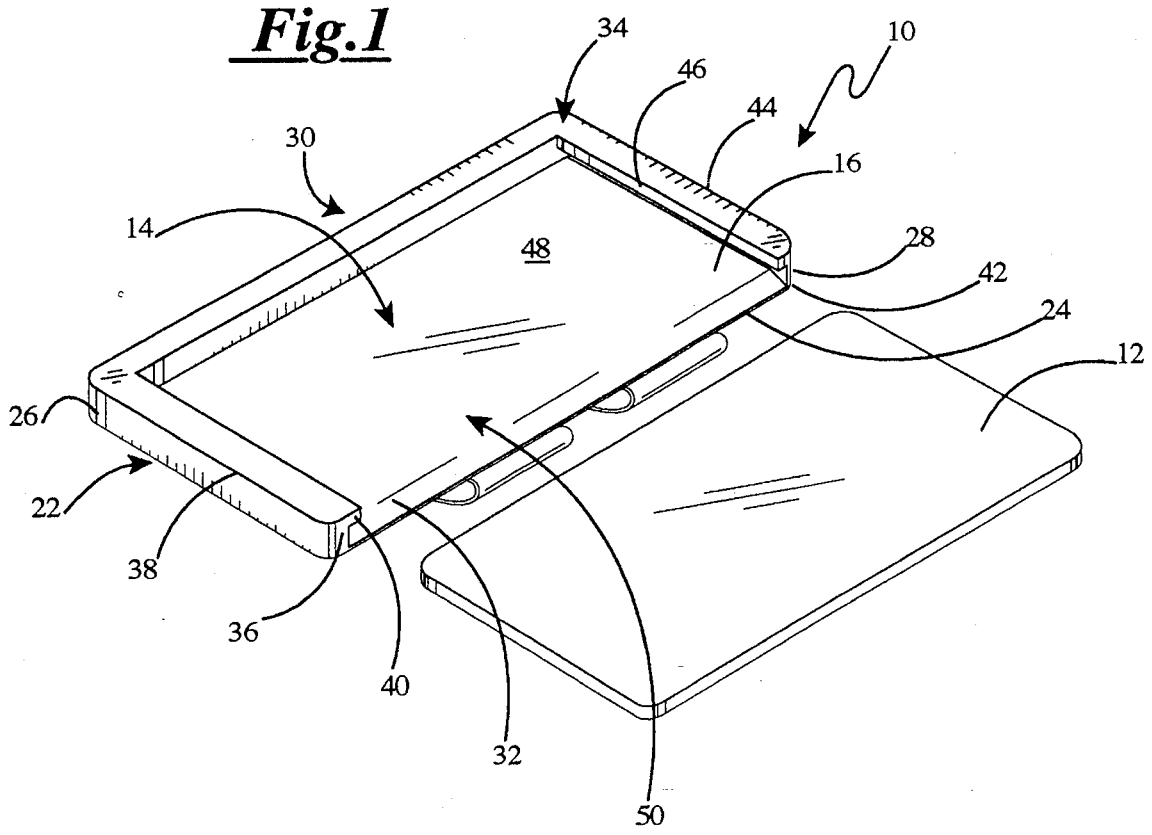
FIG. 1 is a perspective view of a holder with a card aligned and removed.
Figure 5:
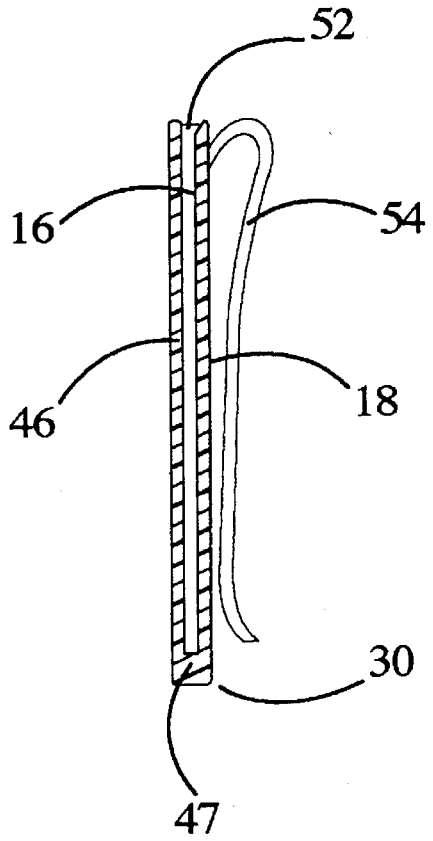
FIG. 5 is a side sectional view of the holder of the type shown in FIG. 1.

Referring first to FIG. 1, there is shown generally a holder 10, and a card 12. The card 12 is aligned but removed from the holder 10. The holder 10 consists of a panel 14, a bottom frame 47 (see FIG. 5), a first side frame 38, a second side frame 44, and a first flexible clip 54 (see FIGS. 2, 3 and 5).

Figure 2:
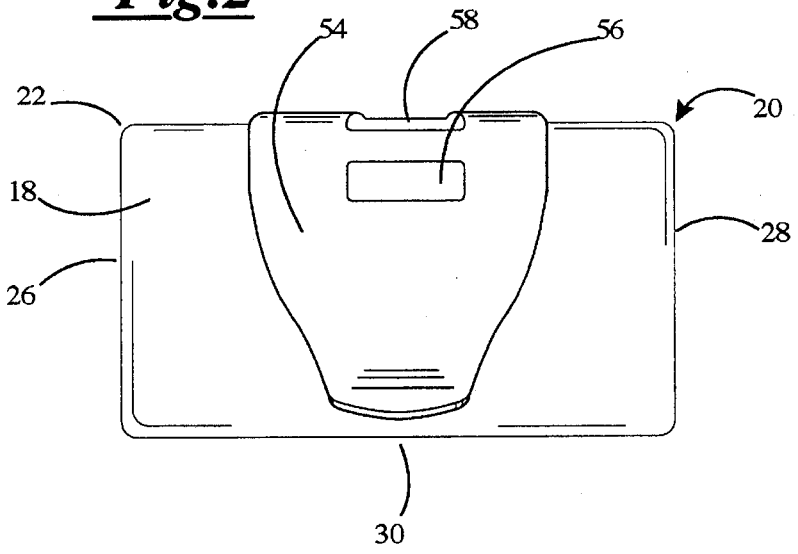
FIG. 2 is a back view of the holder of the type shown in FIG. 1.
Figure 3:
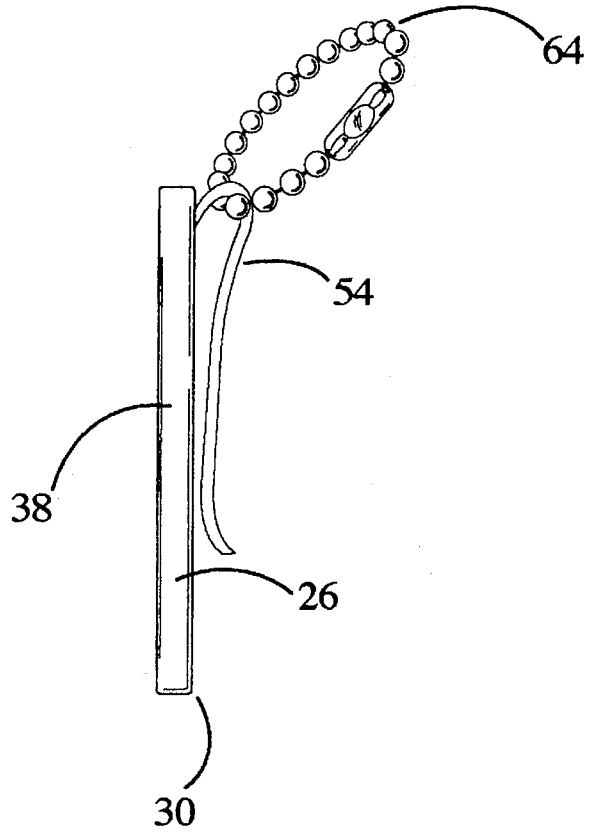
FIG. 3 is a side view of the holder of the type shown in FIG. 1.
Figure 4:
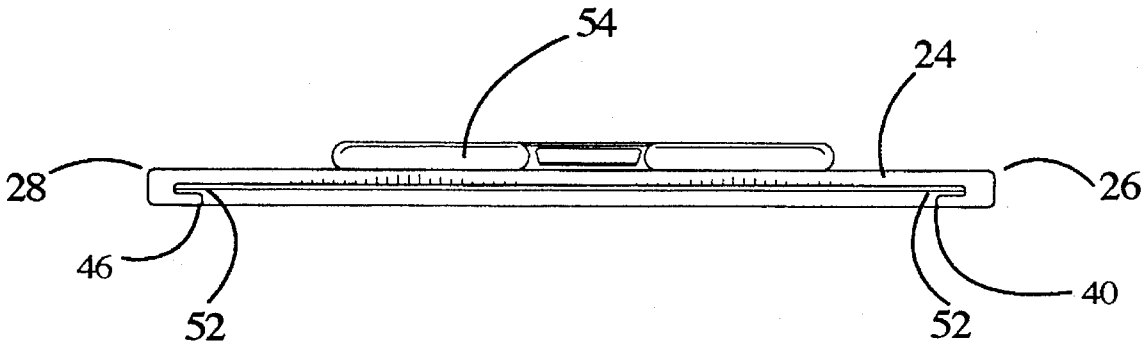
FIG. 4 is a top view of the holder of the type shown in FIG. 1.

Referring to FIGS. 1 and 2, the panel 14 has a front panel portion 16 and back panel portion 18, which are interconnected by a perimeter wall 20. The perimeter wall 20 extends around the perimeter 22 of the panel 14. The panel perimeter may further be defined by a top edge 24, a first side edge 26, a second side edge 28, and a bottom edge 30. Extending perpendicularly outward from the front panel portion 16 is a frame 34. The frame 34 is integral with the panels perimeter 22 and has first and second ends 36 and 42 which form an open top 50. The top edge 24 is adjacent to the open top 50 of the frame 34. The frame 34 extending from the front portion 16 of the panel 14 terminates in a lip which extends perpendicularly inward. The frame 34 and panel 14 cooperate to define a card retaining slot 52 (see FIG. 4). When the card 12 is inserted in the card retaining slot 52, the card is frictionally retained within the frame 34 between the front panel portion 16 opposite the frame 34 and the frame's lip. Those skilled in the art will appreciate that the remaining portion of the front panel 16 does not have to be in frictional contact with the card.

Of course, those skilled in the art will recognize that the geometric shape of the frame 34 may be defined by the geometric shape of the card 12. In the preferred embodiment, the shape of the frame is a rectangle having an open top 50. In particular, the rectangular shape of the frame 34 is defined by a first side frame 38, a second side frame 44 and a bottom frame 47. The first side frame 38 is integral with the panel's 14 side edge 26. The first side frame 38 extends perpendicularly outward from the front panel portion 16, terminating in a first lip 40 which extends perpendicularly inward the entire length of the first side frame 38.

Likewise, the opposing second side frame 44 is integral with the second side edge 28 of the panel 14 and extends perpendicularly outward from the front panel portion 16. The second side frame 44 terminates in a second lip 46 which extends perpendicularly inward the length of the second side frame 44. A bottom frame 47, positioned between the first side frame 38 and the second side frame 44 is integral with the bottom edge 30 of the panel 14 and extends perpendicularly outward from the front panel portion 16. The bottom frame 47 stops the card 12 from sliding out of the holder 10, when the holder is attached to an object in an upright position.

Figure 7:
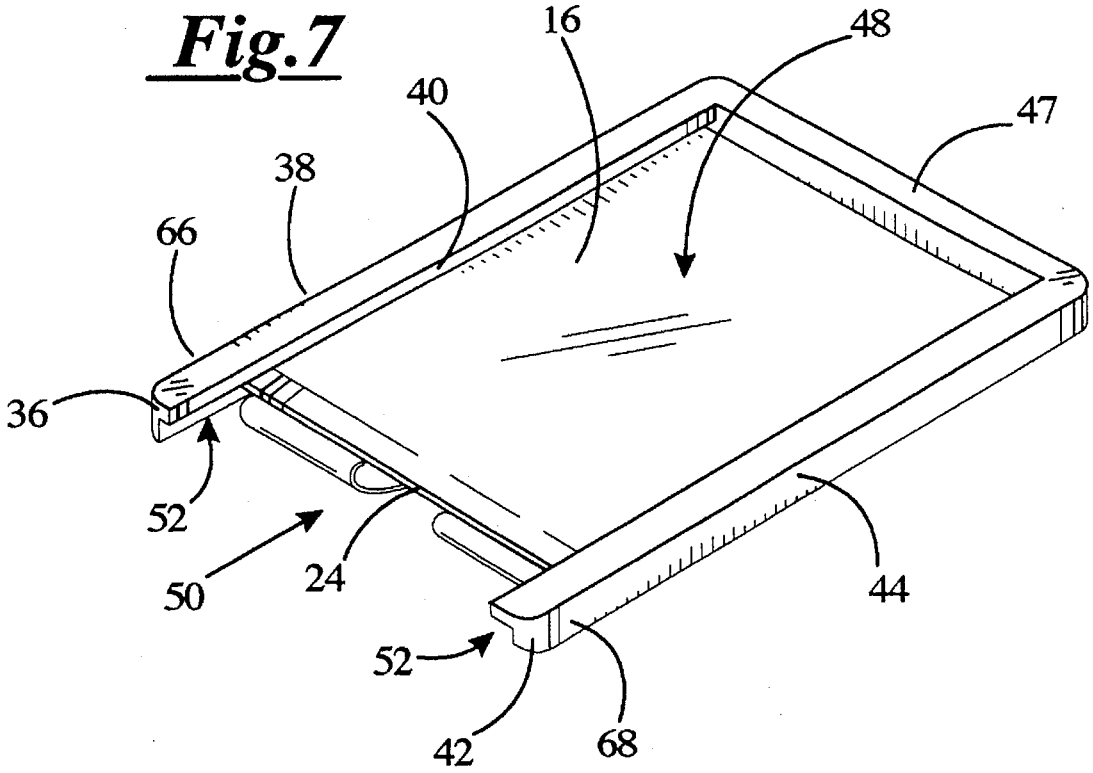
FIG. 7 is a perspective view of an alternate preferred holder.
Figure 8:
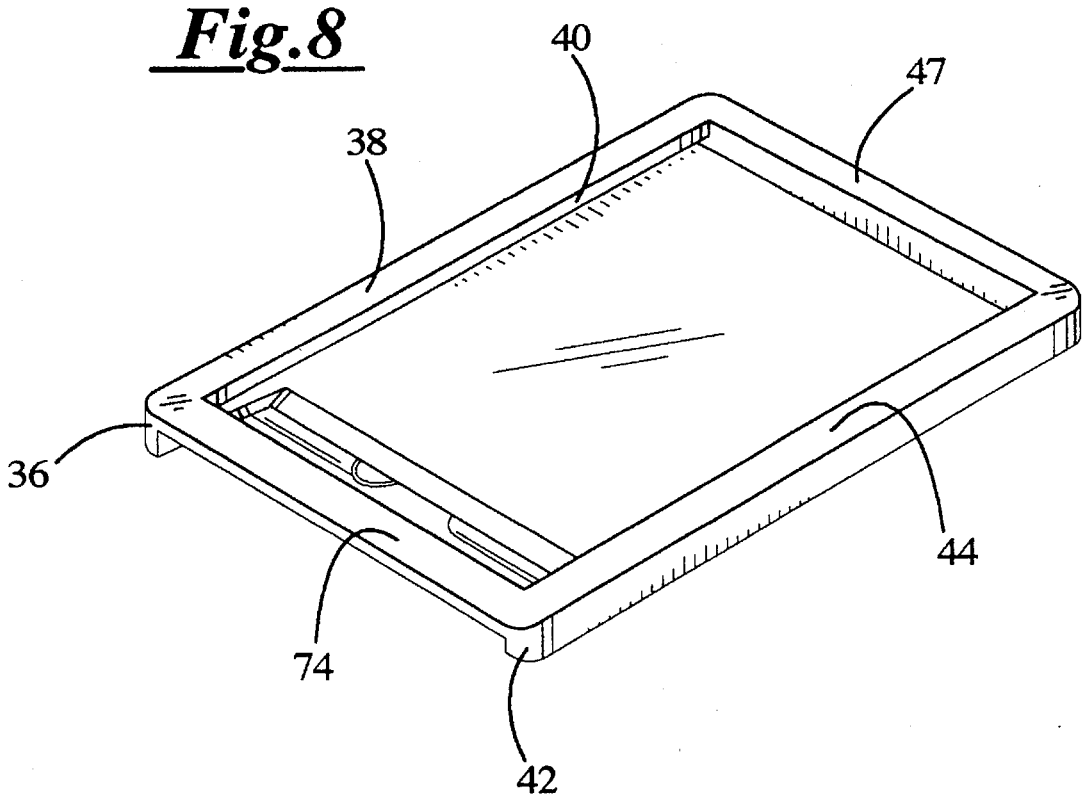
FIG. 8 is a perspective view of the holder of the type shown in FIG. 7, with a crossbar attached.

The frame 34 and panel 14 cooperate to form a holder having an open front 48. The open front 48 permits viewing of the card 12 without removing the card from the holder. The frame 34 and panel 14 also cooperate to define an open top 50 which permits insertion and removal of the card 12. The top edge 24 of the panel's perimeter wall 20 is tapered along a length of the top edge 24. The taper 32 starts from a central portion of the top edge 24 and tapers towards the front panel portion 16. The taper 32 provides ease in inserting the card 12 and guides the card into the card retaining slot 52. The card retaining slot 52 is either slightly larger than the length of the card 12 or slightly larger than the width of the card 12. Hence, the card may be positioned in the holder with its length axis aligned either parallel or perpendicular to the open top 50. FIG. 1 shows a holder, wherein the length axis of an inserted card is parallel to the open top 50. FIGS. 7 and 8 show alternate preferred holders, wherein the length axis of an inserted card is perpendicular to the open top 50.

Referring again to FIG. 2, the back panel portion 18 of the holder 10 is shown. A first flexible clip 54 is molded integral with the back panel portion 18 and extends from the back panel portion 18. The first clip 54 extends from the back panel portion, whereby the holder may be fastened to an object such that the inserted card is in either a horizontal or vertical alignment to a viewer. The first flexible clip 54 has first and second slots 56 and 58 extending therethrough. The first and second slots 56 and 58 allow a strap 60 or a chain 64 to be secured through the first and second slots 56 and 58 (see FIG. 3).

Figure 6:
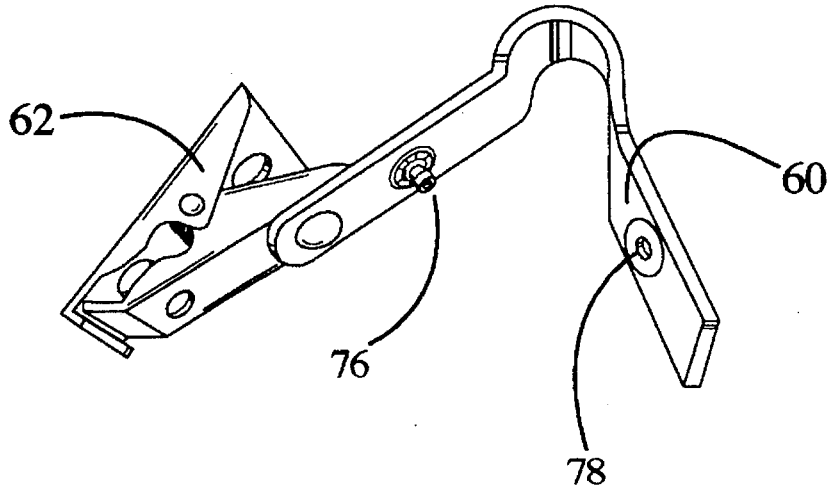
FIG. 6 is a perspective view of a strap having a second clip attached.

A second clip 62 may be attached and extending from the strap 60 (see FIG. 6). The second clip 62 has two opposing members pivotably connected by a rotation pin, wherein a spring forces a gripping end of each member to rotate towards and contact the other member. The gripping ends of the second clip may be spread and then released to clamp onto various objects. Male and female members 76 and 78 of a snap are attached to the strap 60. The strap 60 is inserted through the first and second slots 56 and 58. Then the male and female snap members 76 and 78 are engaged, thereby securing the second clip 62 to the holder 10. The first flexible clip 54, the strap 60, the second clip 62, and the chain 64 all provide various ways to attach the holder 10 to an object. For example, the holder 10 may be clipped, hung, fastened, double clipped, clipped and hung, or clipped and fastened.

The holder 10 is manufactured from a flexible, yet durable, thermoplastic polymer. Without limitation, the holder 10 is molded from polyethylene. Of course, those skilled in the art will recognize that other suitable, flexible yet durable thermoplastic polymers may be used.

Figure 9:
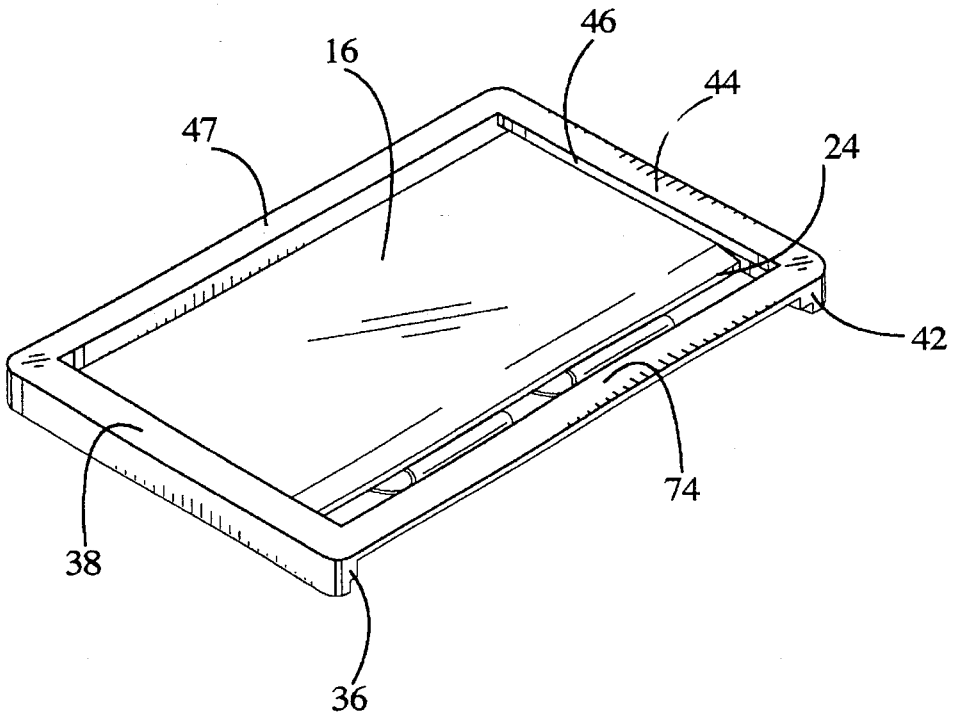
FIG. 9 is a perspective view of another alternate preferred holder.
Figure 10:
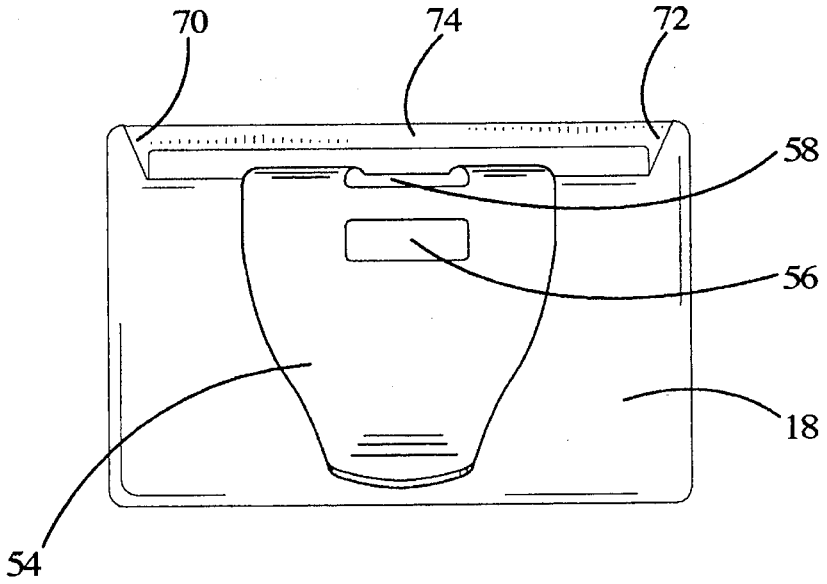
FIG. 10 is a back view of the holder of the type shown in FIG. 9.

Referring next to FIG. 7, an alternate preferred holder 10 is generally shown. The first and second ends 36 and 42 of the respective first side frame 38 and second side frame 44 each extend perpendicularly above the top edge 24 of the panel perimeter wall 20. The first side frame 38 extends perpendicularly above the top edge 24 parallel with the first side edge 26 of the panel 14. Likewise, the second side frame 44 extends perpendicularly above the top edge 24 parallel with the second side edge 28 of the panel 14. The card retaining slot 52 is partially defined by the extended first side frame 66 and the extended second side frame 68. The partially defined card retaining slot tapers away from the top edge to form a wider partial card retaining slot 72 (see FIG. 10). A crossbar 74 may be integrally interposed between the extended first side frame 66 and the extended second side frame 68 (see FIGS. 8–10). The crossbar 74 supports the frame 34 and further defines the open top 50 of the card retaining slot 52. The crossbar 74 also further frames the card 12 when inserted within the holder 10.

Having described the constructional features of the holder 10, the mode of use will now be discussed. The user aligns the card 12 with the open top 50 of the holder 10, and slides the card 12 into the card retaining slot 52. The card 12 is aligned whereby either the width of the card 12 is slightly smaller than the width of the card retaining slot or the length of the card is slightly smaller than the width of the card retaining slot. The card is then retained within the holder 10 by friction between the front panel portion 16 opposing the frame's lip, and the lip of the frame 34. The user may then clip the first flexible clip to, for example, a shirt pocket or pant pocket. Alternatively, the user may extend a strap 60 through the first and second slots 56 and 58 of the first flexible clip 54. After snapping the strap together, thereby fastening the strap to the holder, the user may attach a second clip 62 to the strap 60. The second clip allows the user to alternately fasten the holder to an object.

This invention has been described herein in consideration detail in order to comply with the patent statutes and to provide those skilled in the art with the information necessary to apply the novel principles and to construct and use such specialized components as are required. However, it is to be understood that the invention can be carried out by specifically different equipment and devices, and the various modifications, both as to the equipment details and operating procedures, can be accomplished without departing from the scope of the invention itself.

What is claimed is:

1. A holder for retaining and displaying a card, comprising:

a) a panel having a front portion, a back portion, and a perimeter wall interconnecting said front portion with said back portion;

b) a frame having first and second ends forming an open top, said frame being integral with said perimeter wall, said frame extends perpendicularly outward from the front portion of said panel and terminates in a lip extending perpendicularly inward, wherein said frame and said panel cooperate to:

(i) form said holder having an open front, thereby permitting viewing of the card, (ii) form the open top which permits insertion and removal of the card, and (iii) define a card retaining slot wherein a card is retainable within the frame between the front portion of said panel and said lip;

c) a first flexible clip integral and extending from said back portion of said panel, said flexible clip having first and second slots extending therethrough; and d) a chain secured through said first and second slots of said first clip.

2. The holder as recited in claim 1, wherein a top edge of the perimeter wall adjacent to the open top of said frame is tapered along a length of the top edge from a central portion of the top edge toward the front portion of the panel, wherein the taper provides ease in inserting and guiding a card into said card retaining slot.

3. The holder as recited in claim 1, wherein the holder is manufactured from a thermoplastic polymer.

4. The holder as recited in claim 1, wherein said frame further extends perpendicularly above a top edge of the perimeter wall, thereby forming parallel opposing extended first and second side frames, wherein said card retaining slot is partially defined by said frame and tapers away from said top edge of said panel to form a wider partial card retaining slot.

5. The holder as recited in claim 4, wherein a crossbar is integrally interposed between said opposing extended first and second side frames thereby supporting said frame, wherein said crossbar further defines the open top of the card retaining slot.

6. The holder as recited in claim 1, wherein a card is provided having a predetermined length dimension and wherein said card retaining slot is slightly larger than said length dimension of said card.

7. The holder as recited in claim 1, wherein a card is provided having a predetermined width dimension and wherein said card retaining slot is slightly larger than said width dimension of said card.

8. A holder that retains and displays a card, comprising:

a) a panel having a front portion, a back portion, and a panel perimeter having a top edge, opposing first and second side edges and a bottom edge;

b) a bottom frame integral with the bottom edge of said panel member, and extending perpendicularly outward from the front portion of said panel;

c) a first side frame having a length and being integral with the first side edge of said panel, and extending perpendicularly outward from the front portion of said panel and terminating in a first lip extending perpendicularly inward said length of said first side frame;

d) a second side frame having a length and being integral with the second side edge of said panel, and extending perpendicularly outward from the front portion of said panel and terminating in a second lip extending perpendicularly inward said length of said second side frame; wherein said panel, said bottom frame, said first side frame and said second side frame cooperate to:

(i) form a frame having an open front, thereby permitting view of the card, (ii) form an open top which permits insertion and removal of the card, and (iii) define a card retaining slot wherein a card is retainable within said frame between said front portion of said panel and said first and second lips;

e) a first flexible clip integral and extending from said back portion of said panel, said first flexible clip having first and second slots extending therethrough; and f) a strap and a second clip attached to said strap, said strap being secured through said first and second slots of said first flexible clip.

9. The holder as recited in claim 8, wherein the top edge of said panel perimeter is tapered along a length of the top edge from a central portion of the top edge toward the front portion of the panel, wherein the taper provides ease in inserting and guiding a card into said card retaining slot.

10. The holder as recited in claim 8, wherein the holder is manufactured from a thermoplastic polymer.

11. The holder as recited in claim 8, wherein said first side frame further extends perpendicularly above said top edge of said panel, parallel with said first side edge of said panel, and said second side frame further extends perpendicularly above said top edge of said panel parallel with said second side edge of said panel, wherein said card retaining slot is partially defined by said first and second side frames and tapers away from said top edge of said panel to form a wider partial card retaining slot.

12. The holder as recited in claim 11, wherein a crossbar is integrally interposed between said first and second side frames thereby supporting said frame, wherein said crossbar further defines the open top of the card retaining slot.

13. The holder as recited in claim 8, further comprising a chain secured through said first and second slots of said first clip.

14. The holder as recited in claim 8, wherein a card is provided having a predetermined length dimension and wherein said card retaining slot is slightly larger than said length dimension of said card.

15. The holder as recited in claim 8, wherein a card is provided having a predetermined width dimension and wherein said card retaining slot is slightly larger than said width dimension of said card.

16. A holder for retaining and displaying a card, comprising:

a) a panel having a front portion, a back portion, and a perimeter wall interconnecting said front portion with said back portion;

b) a frame having first and second ends forming an open top, said frame being integral with said perimeter wall, said frame extends perpendicularly outward from the front portion of said panel and terminates in a lip extending perpendicularly inward, wherein said frame and said panel cooperate to:

(i) form said holder having an open front, thereby permitting viewing of the card.

(ii) form the open top which permits insertion and removal of the card, and (iii) define a card retaining slot wherein a card is retainable within the frame between the front portion of said panel and said lip;

c) a first holder attachment means comprising a first flexible clip integral and extending from said back portion of said panel, said flexible clip having first and second slots extending therethrough; and d) a second holder attachment means secured through said first and second slots of said first clip.

17. The holder as recited in claim 6, wherein a top edge of the perimeter wall adjacent to the open top or said frame is tapered along a length of the top edge from a central portion of the top edge toward the front portion of the panel, wherein the taper provides ease in inserting a card and guides a card into said card retaining slot.

18. The holder as retired in claim 16, wherein said panel, frame and first flexible clip is comprised of thermoplastic polymer, wherein a crossbar is integrally interposed between said opposing extended first and second side frames thereby supporting said frame, wherein said crossbar further defines the open top of the card retaining slot and wherein said second attachment means is comprised of an elongated flexible member and a second clip attached to said elongated flexible member extending through said first and second slots of said first clip.

19. The holder as recited in claim 16, wherein said frame further extends perpendicularly above a top edge of the perimeter wall, thereby forming parallel opposing extended first and second side frames, wherein said card retaining slot is partially defined by said frame and tapers away from said top edge of said panel to form a wider partial card retaining slot.

* * * * *